United States Patent [19]

Wilson

[11] 4,455,466

[45] Jun. 19, 1984

[54] SWITCH ACTUATING MECHANISM

[76] Inventor: Dallas W. Wilson, 2015 NW. 23rd Ave., Portland, Oreg. 97210

[21] Appl. No.: 370,178

[22] Filed: Apr. 21, 1982

[51] Int. Cl.[3] ..... H01H 3/14

[52] U.S. Cl. ..... 200/86.5; 200/153 C

[58] Field of Search ..... 200/86.5, 61.89, 153 C, 200/153 T; 338/108, 153; 74/478, 478.5, 512, 560; 251/295

[56] References Cited

U.S. PATENT DOCUMENTS

| | | | |
|---|---|---|---|
| 2,111,311 | 3/1938 | Child | 200/153 C |
| 2,824,921 | 2/1958 | Baumheckel | 200/86.5 |
| 2,832,863 | 4/1958 | Quimby | 200/86.5 X |
| 3,912,892 | 10/1975 | Morehouse | 200/61.89 |
| 4,172,217 | 10/1979 | Miller | 200/86.5 |
| 4,179,949 | 12/1979 | Hildebrecht | 74/560 X |
| 4,388,508 | 6/1983 | Wilson | 200/153 C |

FOREIGN PATENT DOCUMENTS

| | | | |
|---|---|---|---|
| 2104401 | 8/1972 | Fed. Rep. of Germany | 200/86.5 |

*Primary Examiner*—J. R. Scott

*Attorney, Agent, or Firm*—Eugene M. Eckelman

[57] ABSTRACT

A foot pedal is supported in angular relation on a supporting surface by a leaf spring. A switch is carried on the forward end of the foot pedal and has a movable contact arranged to engage an angled portion of the leaf spring when the foot pedal is depressed. The leaf spring extends beyond the rearward end of the foot pedal for receiving fasteners to attach the foot pedal to a supporting surface. The mechanism includes a front auxiliary foot engaging portion above the foot pedal providing a pair of foot engaging areas for individual or combined use. A cover is provided to enclose exposed portions of the switch, and such cover has a selected structure to prevent overtraveling of the switch actuating mechanism.

9 Claims, 5 Drawing Figures

SWITCH ACTUATING MECHANISM

BACKGROUND OF THE INVENTION

This invention relates to new and useful improvements in switch actuating mechanisms.

Some types of foot operated switching mechanisms require frequent use and thus in order to be commercially feasible must be readily actuatable by the foot and also be comfortable in their operation. As an example, it is desirable that foot actuated switches be employed in trucks or the like for the operation of compression brakes. Foot operated switches for such purpose have not appeared as a commercial success because of their lack of the above features, namely, a combination of convenience in operation by the foot and at the same time comfortable to the operator for repeated operation over an extended period.

SUMMARY OF THE INVENTION

According to the present invention and forming a primary objective thereof, a switch actuating mechanism is provided that has a novel structure facilitating efficient engagement by the operator's foot and also one which is comfortable for use over extended periods of time.

More particular objects of the invention are to provide a foot operated switch actuating mechanism which has an enlarged pedal-type foot engaging portion for easy engagement by the foot, which has both a low profile foot engaging portion and an elevated foot engaging portion allowing for different foot positions to relieve leg tensions of the operator, which employs foot engaging portions facilitating engagement by the foot from almost any direction of movement, and which includes means which prevents damaging excessive pressure from being exerted on movable switch parts.

In carrying out the invention, the mechanism employs a foot pedal supported resiliently in an angular position by an elongated bottom leaf spring. A switch is supported on the foot pedal adjacent the forward end thereof and is positioned such that in the rest position of the foot pedal the movable contact plunger of the switch is in one of its operative positions but upon downward depressed movement of the foot pedal the movable contact plunger is moved to its other operative position. The leaf spring extends a short distance rearwardly of the foot pedal, and such projecting end has means for securing the foot pedal to a supporting surface. The leaf spring provides a flexible support for the foot pedal, and the forward end thereof is angled upwardly under the switch so as to form a cushioned abutment for the movable switch contact plunger. The foot pedal includes a forward upwardly offset portion which forms an auxiliary foot engaging portion above the foot pedal portion to provide both a low profile and a raised profile.

The invention will be better understood and additional objects and advantages will become apparent from the following description taken in connection with the accompanying drawings.

DETAILED DESCRIPTION OF A PREFERRED EMBODIMENT

Figure 1:
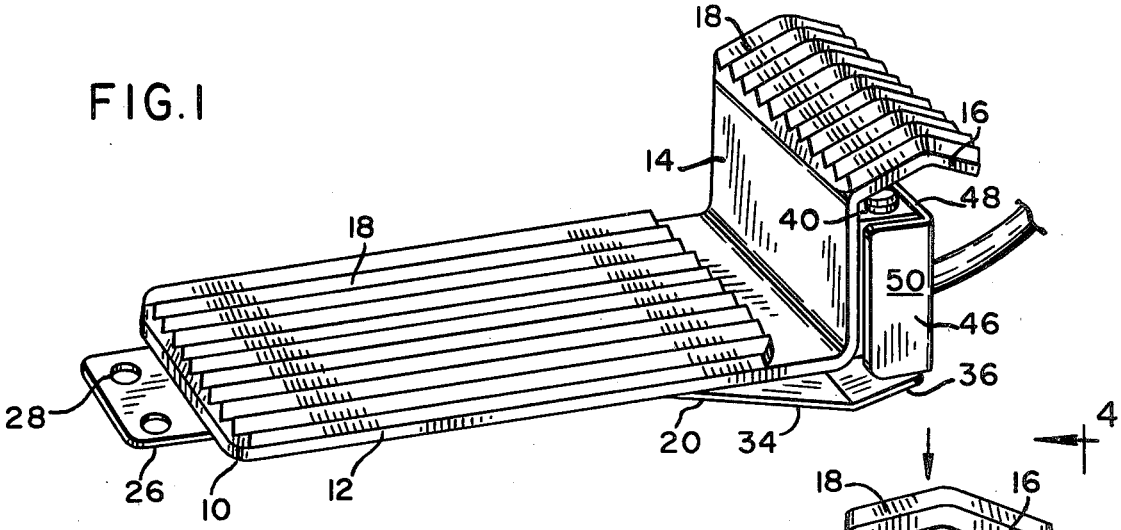
FIG. 1 is a perspective view of a switching mechanism embodying features of the present invention.

With particular reference to the drawings, the switching mechanism of the invention includes a rigid body member 10 having an elongated first foot engaging portion 12, an upturned front wall 14, and a forwardly turned peaked second foot engaging portion 16. Each of the foot engaging portions 12 and 16 is covered with a tread layer 18 or other friction-type surface.

Body member 10 has an elongated leaf spring 20 secured, as by rivets 22, to the bottom surface thereof. Spring 20 has a main flat portion 24 secured against the bottom surface of the body member 10, a portion 26 of the spring projecting from the rearward end of the body member 10. Such rearward projecting end has apertures 28 by means of which the mechanism is arranged to be secured to a supporting surface 30, as by screws 32. Apertures 28 are spaced apart so that a pair of screws will provide a positive anchoring of the body on a supporting surface, such as on a truck cab floor.

The forward end of the leaf spring 20 has portion 34 angled away from the body portion 24 and a forward projecting portion 36 angled back in the reverse direction. This forward portion of the spring supports the mechanism in a preselected angled rest position on a supporting surface.

A micro-switch 40 of the type having a bottom spring operated movable contact plunger 42 is secured to the forward surface of the front wall 14, as by screws 44 threaded into wall 14. Screws 44 also serve to attach a cover 46 constructed of a relatively rigid material so as to provide protection for the switch, such cover being C-shaped, having a front wall 48 and side walls 50 for protection in such areas. The switch 40 is protected from the top by the rigid foot engaging portion 16 and from the rear by the front wall 14. The angular structure of the leaf spring 20, the mounted position of the switch 40, and the flex strength of the spring are such that in the normal rest position of the mechanism, FIG. 2, the spring supports the switching mechanism in an angular position with the plunger 42 of the switch out of engagement with the portion 36 of the leaf spring. For operation of the switch, FIG. 5, the operator presses down on the body 10, either by stepping on the elongated foot engaging portion 12 or the elevated foot engaging portion 16, or both, whereby the plunger engages spring portion 36 and is moved to a switch actuating function.

The structure of the present switch actuating mechanism provides convenience for the operator in contacting it with the foot, namely, the portion 12 is elongated in low profile and sufficiently enlarged so as to be readily accessible. The front portion 16 is also readily accessible, with each of the surfaces 12 and 16 being arranged to be engaged separately or at the same time. The spring 20 may be of sufficient flex strength to allow the operator to rest his foot on it and to be depressible by a greater force. Due to the low profile of the portion 12 and the raised profile of portion 16, the operator can change positions of his foot for relieving tension in the leg.

Figure 2:
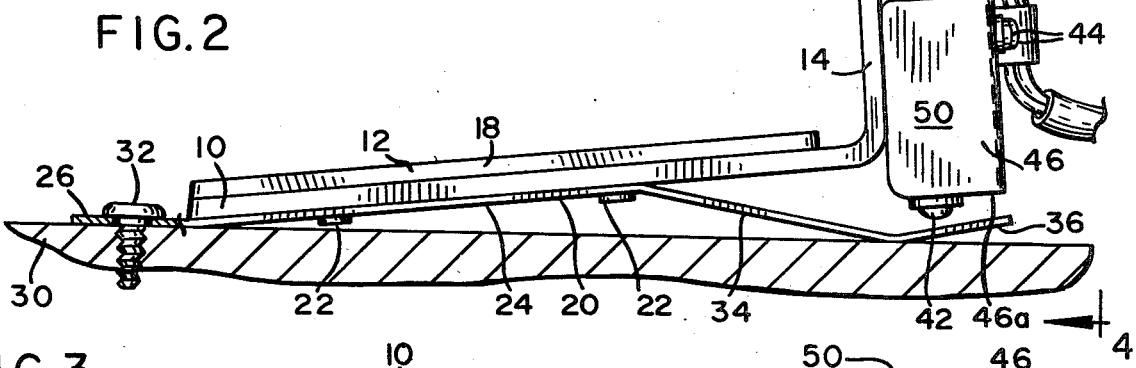
FIG. 2 is a side elevational view of the switching mechanism in reset position.
Figure 3:
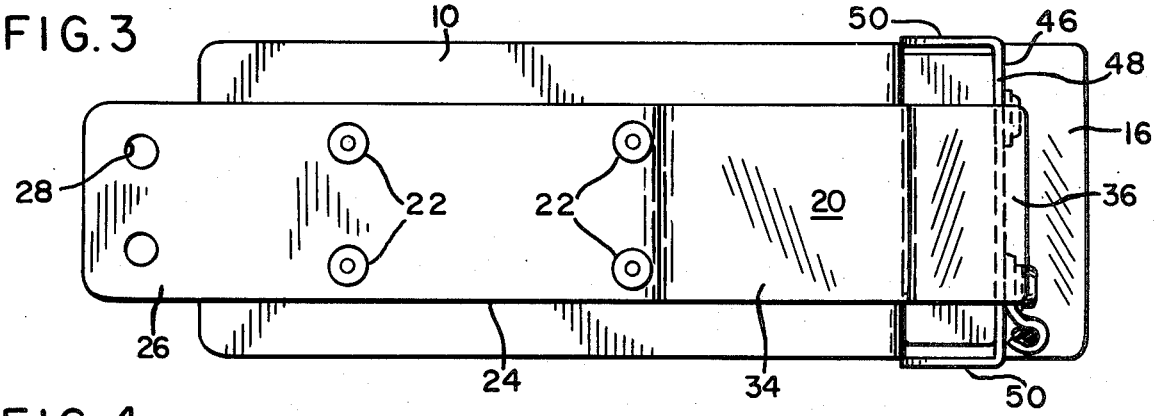
FIG. 3 is a bottom plan view.
Figure 4:
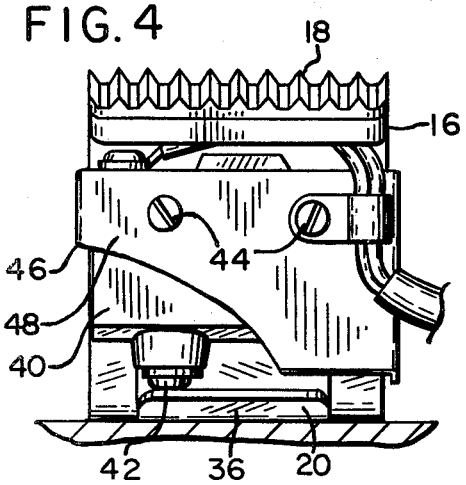
FIG. 4 is an end view taken on the line 4—4 of FIG. 2, a portion of this view being broken away.
Figure 5:
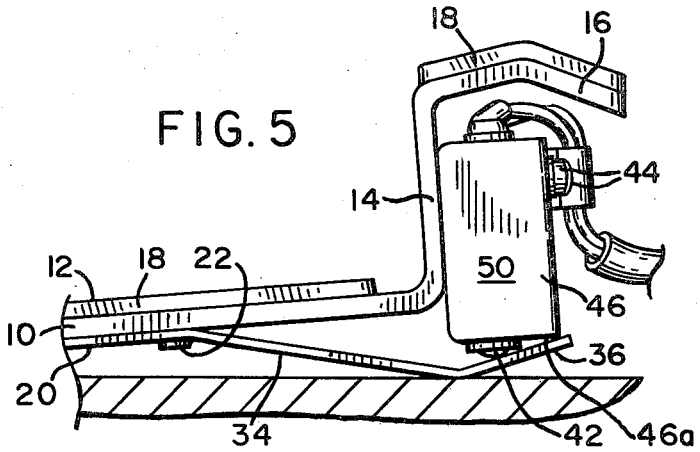
FIG. 5 is a fragmentary side elevational view taken similar to FIG. 2 but showing the mechanism in an operative position.

The spring support of the mechanism 10 also provides a switch mounting which minimizes shock to the mechanism and minimum damage to the plunger 42 of the switch and other parts. More particularly, as best seen in FIG. 2, the mechanism is supported between the projecting rearward end 26 of the spring and the forward angular portion 34 in raised position from the supporting surface, and such, in addition to the offset 34, provides a flexible or cushioned mounting. The forward end 36 of the spring is angled upwardly slightly relative to the plane of the body 10 to further provide flexibility in the engagement between this portion of the spring and the plunger 42. The cover 46 is positioned on the body 10 whereby the bottom edge **46*a* thereof is spaced only a short distance above the projecting movable contact 42 and more particularly a location whereby such bottom edge will impinge against the spring portion 36 to form a stop for preventing excessive pressure on the switch contact. This limited movement by the bottom edge 46*a* is illustrated in FIG. 5**.

It is to be understood that the form of my invention herein shown and described is to be taken as a preferred example of the same and that various changes in the shape, size and arrangement of parts may be resorted to without departing from the spirit of my invention or the scope of the subjoined claims.

Having thus described my invention, I claim:

1. A switch actuating mechanism comprising (a) an elongated rigid foot pedal having forward and rearward ends, (b) an elongated leaf spring secured longitudinally to the bottom of said foot pedal, (c) said spring having a downwardly disposed offset portion adjacent the forward end of said foot pedal for resiliently supporting the forward end of said foot pedal off a supporting surface, (d) and a switch supported on said foot pedal adjacent said forward end and having a movable contact plunger with a pair of operative positions, (e) said offset portion having a free end extending under the plunger of said switch, (f) said switch being positioned such that in the rest position of said foot pedal, its plunger is in one of its operative positions but upon downward depressed movement of said foot pedal under operator control, said plunger engages said free end of said leaf spring for movement to its other operative position.

2. The switch actuating mechanism of claim 1 wherein said offset portion terminates in an upwardly angled end under said plunger providing a flexible abutment for said plunger.

3. The switch actuating mechanism of claim 2 wherein said leaf spring extends longitudinally of said body member, means adjacent the rear of said leaf spring arranged to secure said foot pedal to a supporting surface, said offset portion being angled upwardly in the area under said plunger to provide a cushioned abutment for said plunger.

4. The switch actuating mechanism of claim 1 wherein said leaf spring extends longitudinally of said body member with a portion thereof projecting rearwardly beyond said body member to provide a flexible rear support, and means on the projecting portion of said leaf spring arranged to secure said foot pedal to a supporting surface.

5. The switch actuating mechanism of claim 1 including a cover plate on said switch, said cover plate having a bottom edge arranged selectively so as to abut against said free end to prevent over-travel of said plunger.

6. A switch actuating mechanism comprising (a) an elongated rigid foot pedal having forward and rearward ends, (b) an elongated leaf spring secured longitudinally to the bottom of said foot pedal and having a forward angled portion for supporting the forward end of said foot pedal off a supporting surface, (c) said spring having a rear projecting end arranged to secure said foot pedal resiliently to a supporting surface whereby said foot pedal is resiliently supported on the supporting surface between said forward angled portion and said rear projecting end, (d) and a switch supported on said foot pedal adjacent said forward end and having a movable contact plunger with a pair of operative positions, (e) said switch being positioned such that in the rest position of said foot pedal, its plunger is in one of its operative positions but upon downward depressed movement of said foot pedal under operator control, its plunger is moved to its other operative position.

7. A switch actuating mechanism comprising (a) an elongated rigid foot pedal having forward and rearward ends, (b) an elongated leaf spring secured longitudinally to the bottom of said foot pedal and angled away from said foot pedal toward the forward end for resiliently supporting the forward end of said foot pedal off a supporting surface, (c) and a switch supported on said foot pedal adjacent said forward end and having a movable contact plunger with a pair off operative positions, (d) said foot pedal having an upwardly directed offset portion adjacent the forward end thereof forming an auxiliary foot engaging portion above said foot pedal, (e) said switch being positioned such that in the rest position of said foot pedal, its plunger is in one of its operative positions but upon downward depressed movement of said foot pedal under operator control, its plunger is moved to its other operative position.

8. The switching actuating mechanism of claim 2 including a tread surface on each of said foot engaging portions.

9. The switch actuating mechanism of claim 2 wherein said auxiliary foot engaging portion extends over said switch to comprise a protective cover.

* * * * *